US005950458A

United States Patent [19]

Meyer et al.

[11] Patent Number: 5,950,458

[45] Date of Patent: Sep. 14, 1999

[54] WASHING AND CLEANING DEVICE

[76] Inventors: Dieter Meyer, Erlengrundstrasse 45, Bad Nenndorf, Germany, D-31542; Hans-Peter Braun, Bahnhofstrasse 6, Neustadt, Germany, D-31535

[21] Appl. No.: 09/051,162

[22] PCT Filed: Aug. 19, 1997

[86] PCT No.: PCT/DE97/01774

§ 371 Date: Apr. 2, 1998

§ 102(e) Date: Apr. 2, 1998

[87] PCT Pub. No.: WO98/07917

PCT Pub. Date: Feb. 26, 1998

[30] Foreign Application Priority Data

Aug. 20, 1996 [DE] Germany ..... 196 33 471

[51] Int. Cl.[6] ..... D06F 17/02

[52] U.S. Cl. ..... 68/13 R; 68/184

[58] Field of Search ..... 68/13 R, 13 A, 68/51, 53, 131, 134, 148, 151, 184; 134/187, 188, 192

[56] References Cited

U.S. PATENT DOCUMENTS 2,529,001 11/1950 Casse ..... 68/184

4,025,427 5/1977 Lueb .

FOREIGN PATENT DOCUMENTS 547436 11/1959 Belgium .
600017 1/1926 France .
314310 3/1918 Germany .
3238559 4/1984 Germany .
91 07 440 U 1/1993 Germany .

OTHER PUBLICATIONS

Pantent Abstracts of Japan vol. 095, No. 010, Nov. 30, 1995 JP07171293A.

*Primary Examiner*—Philip R. Coe
*Attorney, Agent, or Firm*—Collard & Roe, P.C.

[57] ABSTRACT

Disclosed is a washing and cleaning device, which is placed or can be placed in a washing vessel with a washing liquid. During the cleaning process the washing and cleaning device is surrounded on the outside by items to be cleaned. It comprises a housing unit with liquid inlet and outlet holes on its surface. Inside the housing at least one rotating element, which also exhibits liquid inlet and outlet holes on its surface, is accommodated. During the cleaning process, the rotating element is rotated relative to the housing unit by means of a driving mechanism.

8 Claims, 3 Drawing Sheets

WASHING AND CLEANING DEVICE

The invention relates to a washing and cleaning device.

Dirt is generally eliminated in material to be cleaned by mechanical processes in a liquid provided with solvent. The success of the cleaning operation is often dependent on the quality and intensity of the mechanical process and the composition of the solvent, whereby a not inconsiderable and wearing load occurs in the material to be cleaned. Reducing the mechanical process diminishes the washing and cleaning result unless stronger solvents are added.

Some manufacturers offer washer inserts together with the detergent, which are filled with the required amount of detergent and, together with the material to be cleaned, are plugged into the drum of a conventional washing machine. In this case, the detergent is not added in metered amounts via the metering compartments of the washing machine. Detergent is dissolved in the course of the washing process, and insoluble detergent is retained in the washer insert. However, as the washing drum is rotating, the washer insert together with the material to be cleaned is moved as well, which supports and improves the solubility of the detergent.

The invention has an object of creating a washing and cleaning device which largely protects the cleaning stock against mechanical stress and requires less or no solvent.

As opposed to the known washer insert, which is moved along only passively by the motion of the drum, the washing and cleaning device as defined by the invention is itself an active element. Therefore, it can be used in common vessels such as buckets, sinks, bathtubs and washtubs, or also supplementarily in conventional washing machines, where the washing and cleaning device is immersed in the washing liquid in about the center between the cleaning stock.

The washing liquid present in the interior of the housing unit is swept along by the rotary motion of the rotatable element within the housing unit and put into rotation as well. Centrifugal forces act on the rotating washing liquid, causing a radial exit of flow through the liquid outlet holes on the jacket surface of the rotating element and the housing unit. Liquid inlet holes in the center or on the face side of the rotary motion at the same time permit after-flow of washing liquid.

The washing and cleaning device operates in a way similar to a circulation pump in that the washing liquid in the vessel is put into a rotating flow, which is first directed radially outwardly by the liquid outlet holes on the surface of the housing unit, flows through the cleaning stock, dragging along dirt particles, subsequently hits the wall of the vessel, and then returns axially on the surface and on the bottom to the center and flows back into the housing unit through the liquid inlet holes.

With the washing and cleaning device as defined by the invention, the cleaning stock remains substantially quietly resting in the washing liquid because the housing unit is not moved. The cleaning stock is therefore significantly more carefully treated than with conventional moving drums. However, the washing liquid itself is forced through the cleaning stock at a high flow rate, which improves the detachment of dirt particles. Due to the development of eddying of the washing liquid, oxygen is carried along at the same time from the environment and absorbed, supporting the cleaning effect.

Furthermore, the constant direction of flow permits dirt particles to completely exit from the cleaning stock, so that such particles will not only flow back and forth between different layers of fabric. Moreover, it was observed that the flow rate forces dirt particles against the walls of the vessel, where they stick to the wall, or that dirt particles lump together, forming larger particles, and deposit in less strongly agitated zones of the washing vessel. As such particles will no longer contaminate the washing liquid, the potential of the latter for absorbing more dirt particles from the cleaning stock is increased.

According to a further development of the invention, several rotatable elements can be rotatably supported within the housing unit, one disposed in the other, whereby such rotatable elements may be rotatable in the same sense or in opposite directions.

In the present embodiment, the contact between the rotatable elements and the washing liquid is increased in a number of radial steps, which improves the capacity of the device. Furthermore, this creates the precondition for obtaining through a greater contact area with the elements of the device as defined by the invention also chemical or physical changes in the washing liquid if said elements have catalytic properties imparted by their material or surfaces.

Furthermore, at least one stationary element may be additionally arranged within the housing unit.

This partly reduces the rotary motion of the washing liquid and intensifies the contact with the surfaces of the rotatable elements and the stationary element, which enhances their effect if catalytic properties of the elements are present.

The housing unit and/or the stationary element and/or the rotatable element may comprise an ion absorber and ion exchanger, which may be in the form of a zeolite.

The washing liquid can be softened by the ion exchanger, so that its absorptive power and solubility for impurities of the cleaning stock is improved. The addition of detergent can then be reduced further or even dispensed with altogether. Ion absorbers or exchangers in the form of zeolites, i.e., water-containing aluminum silicates with three-dimensional lattice structures, exhibit particularly good properties for absorbing and exchanging ions.

The inlet holes are usefully distributed over the face side and the outlet holes over the jacket side of the housing unit and/or stationary element and/or rotatable element.

In this way, the washing liquid is evenly injected into the cleaning stock surrounding the housing unit and a regular return flow into the housing unit is obtained.

The housing unit and/or the stationary element and/or the rotatable element may be shaped spherically or ellipsoidally, or have a conical or cylindrical shape.

The washing and cleaning device as defined by the invention can be adapted in this way to existing shapes of washing vessels, and the cleaning effect can be optimized in this way as well.

Furthermore, the drive can be an electric motor and encapsulated liquid-tight.

The washing and cleaning device as defined by the invention can then be operated also automatically, with its axis of rotation in the horizontal position below the level of the liquid.

Exemplified embodiments of the invention are explained in the following by reference to the drawing, in which.

Figure 1:
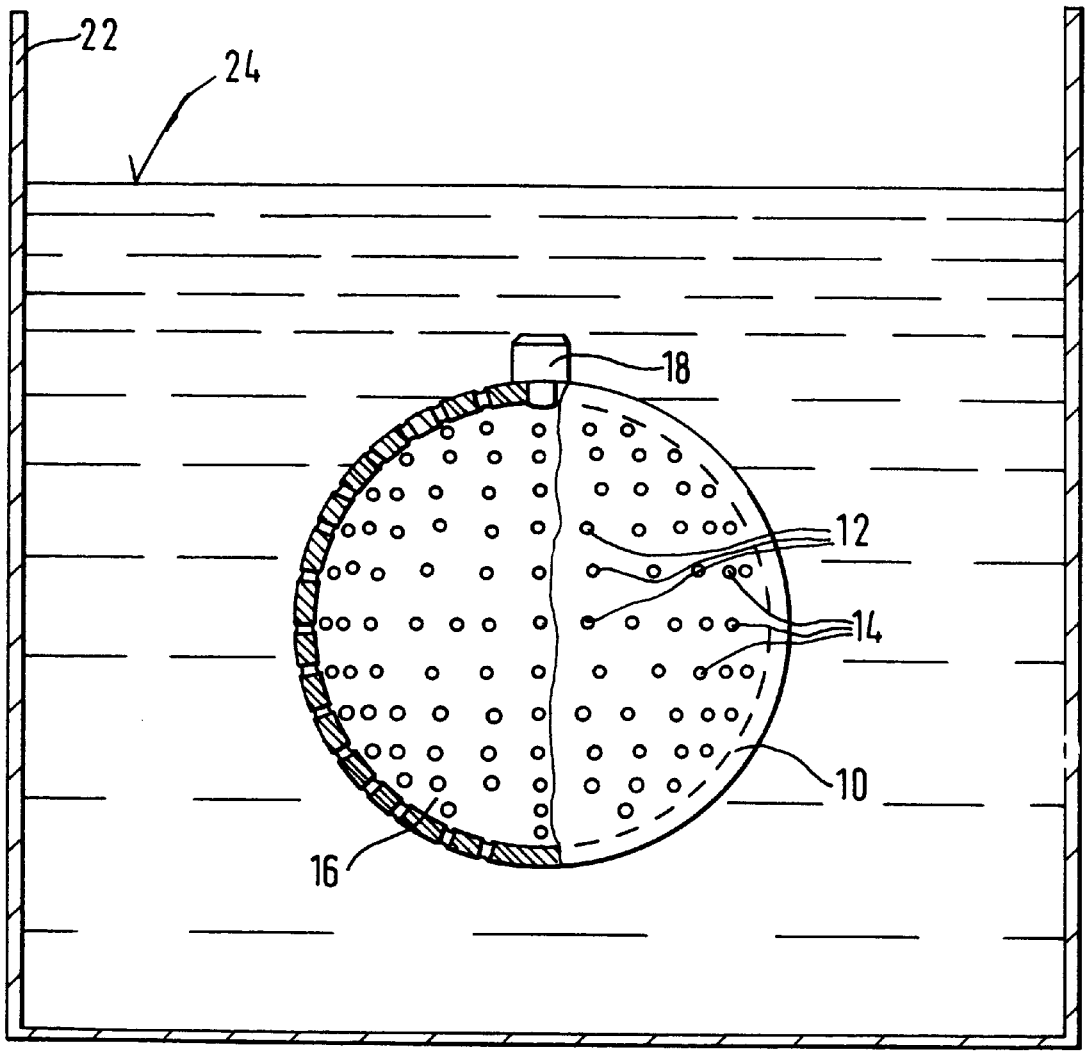
FIG. 1 shows a partly sectional top view of a spherically shaped washing and cleaning device.

The washing and cleaning device according to FIG. 1 comprises a ball-shaped housing unit (10) covered by holes on its surface. A rotatable element (16) is arranged in the interior of the housing unit and covered by holes on its surface as well. An encapsulated electric motor drive (18) is shown outside of the housing unit.

When rotatable element (16) is put into rotation by drive (18) around its axis of rotation, washing liquid 24 is carried along and rotated as well, and, by the centrifugal force of the rotating washing liquid, forced radially outwardly through the holes of the rotating element (16) and the housing unit (10). The holes disposed farther away from the axis of rotation then serve as liquid outlet holes (14), whereas the holes closer to the axis of rotation serve as liquid inlet holes (12). The washing liquid then flows radially through the cleaning stock not shown here, which is disposed outside the housing unit. Washing machine 22 contains the washing liquid 24.

Figure 2:
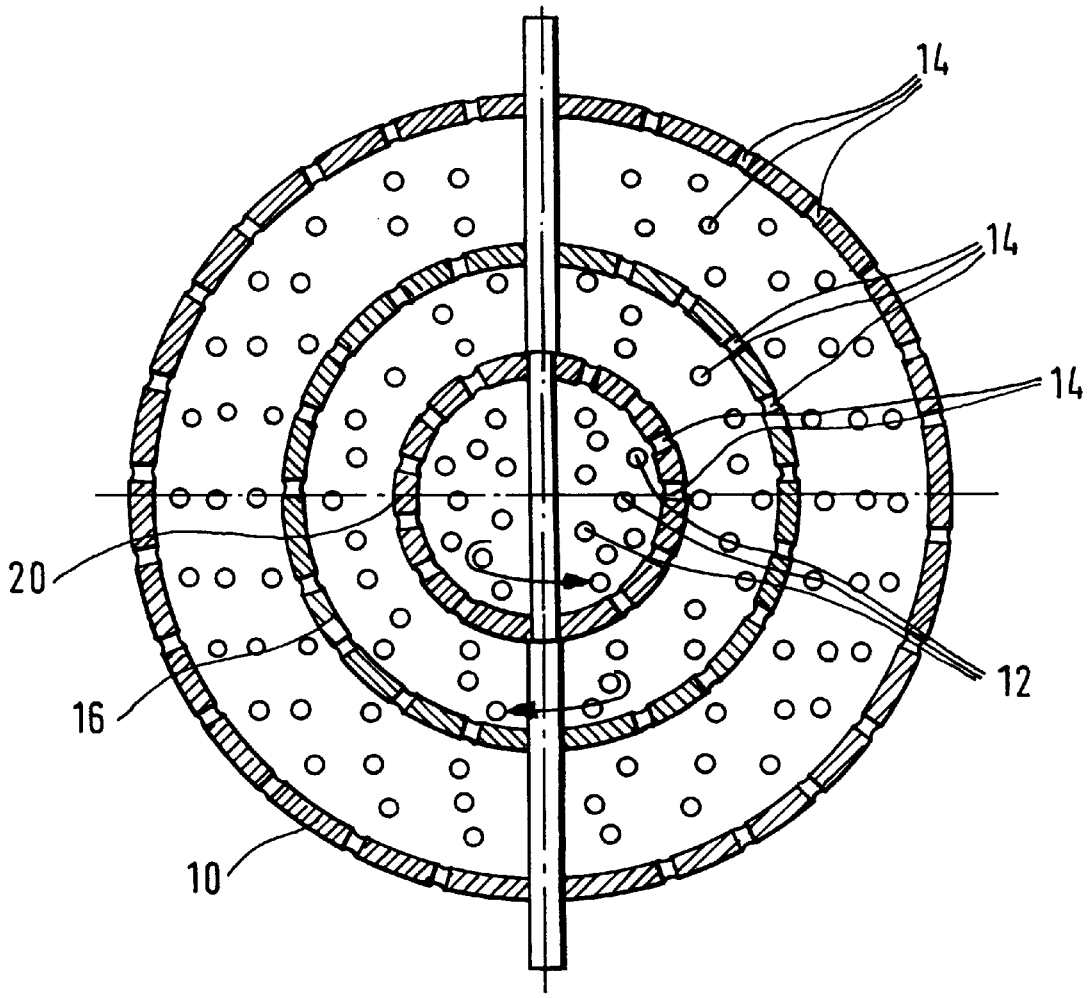
FIG. 2 shows a cross section through another spherically shaped washing and cleaning device.

FIG. 2 shows a washing and cleaning unit, in which the housing unit (10) is spherically shaped as well, and which accommodates two ball-shaped, rotatable elements (16, 20). The rotatable elements (16, 20), which are coaxially disposed one in the other, are arranged with radially stepped diameters. The rotatable elements (16, 20) may rotate in the same sense or in opposite directions.

Figure 3:
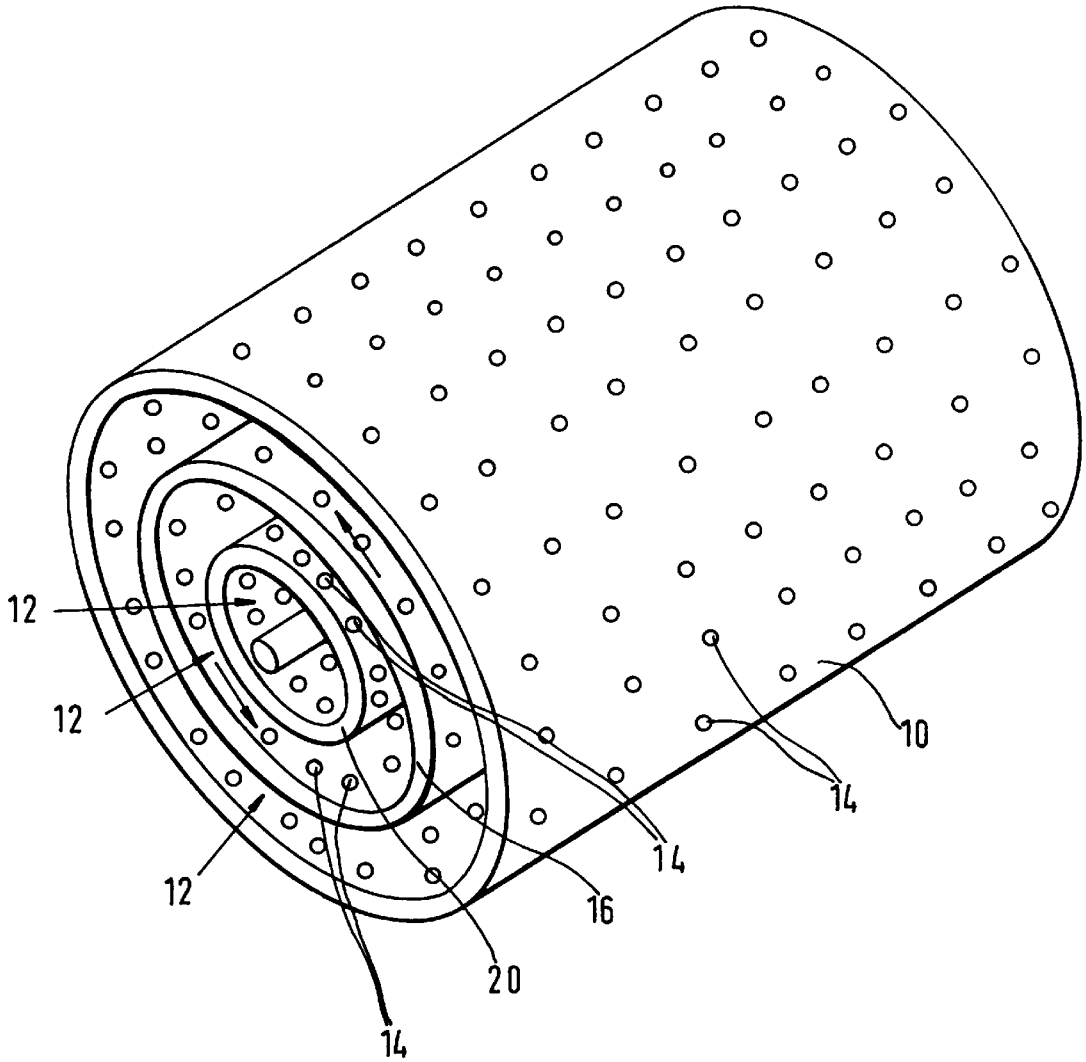
FIG. 3 is a perspective representation of cylindrical washing and cleaning device.

In the washing and cleaning device according to FIG. 3, the jacket surfaces of all elements (10, 16, 20) are shaped cylindrically. Liquid outlet holes (14) are present on said jacket surfaces, whereas the face sides, which are open here, serve as liquid inlet holes (12). In this case too, the rotatable elements (16, 20) may rotate in the same sense or in opposite directions.

We claim:

1. A washing and cleaning device arranged or arrangeable in a washing vessel containing a washing liquid and surrounded externally by a cleaning stock during a cleaning process, said washing and cleaning device comprising a housing unit having a surface and having liquid inlet holes and liquid outlet holes on said surface;

said housing unit having an interior and accommodating in said interior at least one rotatable element; said rotatable element having a surface and having liquid inlet holes and liquid outlet holes on said surface; and drive means for rotating the rotatable element relative to the housing unit during the cleaning process;

whereby through a centrifugal force of a jointly rotating washing liquid, the washing liquid is forced radially outwardly through the holes of the rotatable element and the housing unit and flows through the cleaning stock disposed outside of the housing unit.

2. The washing and cleaning device according to claim 1, further comprising several rotatable elements disposed one within each other;

means for rotatably supporting said elements within the housing unit; and said rotatable elements being rotatable in a same direction or in an opposite direction.

3. The washing and cleaning device according to claim 2, comprising said rotatable elements rotatable in the opposite direction.

4. The washing and cleaning device according to claim 1, wherein the housing unit and/or the rotatable element comprise an ion absorber and ion exchanger.

5. The washing and cleaning device according to claim 4, wherein said ion absorber and ion exchanger is a zeolite.

6. The washing and cleaning device according to claim 1, wherein said housing unit and/or said rotatable element each have a face side and each have a jacket side; and the inlet holes are disposed on the face side and the outlet holes are disposed uniformly distributed on the jacket side of the housing unit and/or the rotatable element.

7. The washing and cleaning device according to claim 1, wherein the housing unit and/or the rotatable element each have a shape selected from the group consisting of spherical, ellipsoidal, conical, and cylindrical.

8. The washing and cleaning device according to claim 1, wherein the drive means is an electric motor encapsulated within a liquid-tight means.

* * * * *